US006334786B1

(12) United States Patent
Lee

(10) Patent No.: US 6,334,786 B1
(45) Date of Patent: Jan. 1, 2002

(54) SUBSCRIBER IDENTIFICATION MODULE CARD FIXING SEAT WITH SLIDABLE AND LATERALLY LATCHING COVER

(75) Inventor: Ipson Lee, Taoyuan (TW)

(73) Assignee: Super Link Electronics Co., Ltd., Taoyuan (TW)

( * ) Notice: Subject to any disclaimer, the term of this patent is extended or adjusted under 35 U.S.C. 154(b) by 0 days.

(21) Appl. No.: 09/711,142

(22) Filed: Nov. 14, 2000

(51) Int. Cl.[7] ..... H01R 13/62
(52) U.S. Cl. ..... 439/331; 439/326
(58) Field of Search ..... 439/331, 326, 439/73

(56) References Cited

U.S. PATENT DOCUMENTS 5,226,826 A * 7/1993 Nillson et al. ..... 439/73
6,210,193 B1 * 4/2001 Ito et al. ..... 439/326

* cited by examiner

*Primary Examiner*—Neil Abrams
*Assistant Examiner*—Phuong Dinh
(74) *Attorney, Agent, or Firm*—Rosenberg, Klein & Lee

(57) ABSTRACT

Subscriber identification module card fixing seat with slidable and laterally latching cover, including: a base seat, a top face of the base seat being recessed to form a receiving cavity in which a subscriber identification module card can be snugly received and bridged, multiple connecting terminals being arranged and inlaid in a bottom board body of the receiving cavity for electrically connecting with the subscriber identification module card, at least one shaft seat being disposed on one side of the receiving cavity of the base seat; and an upper cover including a cover board. A first side of the cover board is connected with a rotary shaft which is slidably pivotally mounted in the shaft seat of the base seat. At least one latch hook downward projects from a second side of the cover board for slidably hooking and latching the base seat, whereby the cover board can firmly press the subscriber identification module card against the base seat so as to make the subscriber identification module card electrically connect with the connecting terminals. The shaft seat of the base seat is disposed on a lateral side of the receiving cavity so that the length of the base seat is shortened and the room necessary for installation is reduced.

2 Claims, 6 Drawing Sheets

SUBSCRIBER IDENTIFICATION MODULE CARD FIXING SEAT WITH SLIDABLE AND LATERALLY LATCHING COVER

BACKGROUND OF THE INVENTION

1. Field of the Invention

The present invention relates to a subscriber identification module (SIM) card fixing seat with slidable and laterally latching cover. The upper cover of the fixing seat is slidably pivotally mounted in a shaft seat disposed on a lateral side of a receiving cavity of the base seat. The upper cover can be turned from a lateral side of the base seat and latched with the base seat so as to firmly press a SIM card against the connecting terminals to electrically connect therewith.

2. Description of the Prior Art

FIGS. 1 and 2 shows a conventional fixing seat for subscriber identification module (SIM) card used in a mobile phone. The fixing seat includes a base seat 5 and an upper cover 6 pivotally connected with the base seat 5. Leaf springs and leads are disposed on the base seat 5 for respectively electrically connecting with the SIM card and the internal chip and circuit of the mobile phone. Two sides of one end of the base seat 5 are respectively formed with two transversely extending guide channels. Two sides of one end of the upper cover 6 are respectively formed with two pivot bosses for fitting into the guide channels. Two sides of the other end of the upper cover 6 are formed with two inward perpendicularly bent edges directed to the end edges of the base seat 5. The end of the bent edge directed to the pivot boss is further formed with a restricting projecting plate. The horizontal bending length of the restricting projecting plate is larger than the horizontal bending length of the bent edge. In addition, the restricting projecting plate more projects to the base seat 5 than the bent edge. Therefore, a step is formed between the restricting projecting plate and the bent edge. In addition, two sides of the other end of the base seat 5 are formed with two horizontal restricting edges each having a notch corresponding to the restricting projecting plate of the upper cover 6.

The above structure has some shortcomings as follows:

1. As shown in FIG. 2, the opposite pivot bosses 61 of two sides of front end of the upper cover 6 are pivotally fitted in the guide channels 51 of two sides of front end of the base seat 5. The axis of the pivot bosses 61 is normal to the sliding direction of the upper cover 6. In order to provide a sufficient space for the pivot bosses 61 to slide in a direction along the long axis Y of the base seat 5, the base seat 5 must be elongated along the long axis Y to a certain extent. That is, the length L1 of the base seat 5 in the direction of long axis Y must be considerably larger than the length L2 of the SIM card C to be installed. This leads to waste of material. In addition, the space necessary for mounting the fixing cartridge on the mobile phone is relatively large. This makes difficult to reduce the volume of the mobile phone.

2. In use of the fixing cartridge, a user first places the SIM card C into the upper cover 6 which is turned up. Then the upper cover 6 with the SIM card C is closed toward the base seat 5 to make the SIM card C attach to the terminals of the base seat 5. However, when placing the SIM card C into the upper cover 6, the SIM card C must be placed in a certain direction. That is, a cut angle of the SIM card C must be aimed at an oblique side of a corner of the base seat 5. However, the upward turned upper cover 6 and the base seat 5 contain an angle and are positioned on different levels. To some users, it often takes place that the SIM card C is placed into the upper cover 6 in an incorrect direction. Under such circumstance, in case that the upper cover 6 is forcedly closed toward the base seat 5, the SIM card C will be damaged.

SUMMARY OF THE INVENTION

It is therefore a primary object of the present invention to provide a subscriber identification module card fixing seat with slidable and laterally latching cover, including: a base seat, a top face of the base seat being recessed to form a receiving cavity in which a subscriber identification module card can be snugly received and bridged, multiple connecting terminals being arranged and inlaid in a bottom board body of the receiving cavity for electrically connecting with the subscriber identification module card, at least one shaft seat being disposed on one side of the receiving cavity of the base seat; and an upper cover including a cover board. A first side of the cover board is connected with a rotary shaft which is slidably pivotally mounted in the shaft seat of the base seat. At least one latch hook downward projects from a second side of the cover board for slidably hooking and latching the base seat, whereby the cover board can firmly press the subscriber identification module card against the base seat so as to make the subscriber identification module card electrically connect with the connecting terminals. The shaft seat of the base seat is disposed on a lateral side of the receiving cavity so that the length of the base seat is shortened and the room necessary for installation is reduced.

The present invention can be best understood through the following description and accompanying drawings wherein:

DETAILED DESCRIPTION OF THE PREFERRED EMBODIMENT

Figure 1:
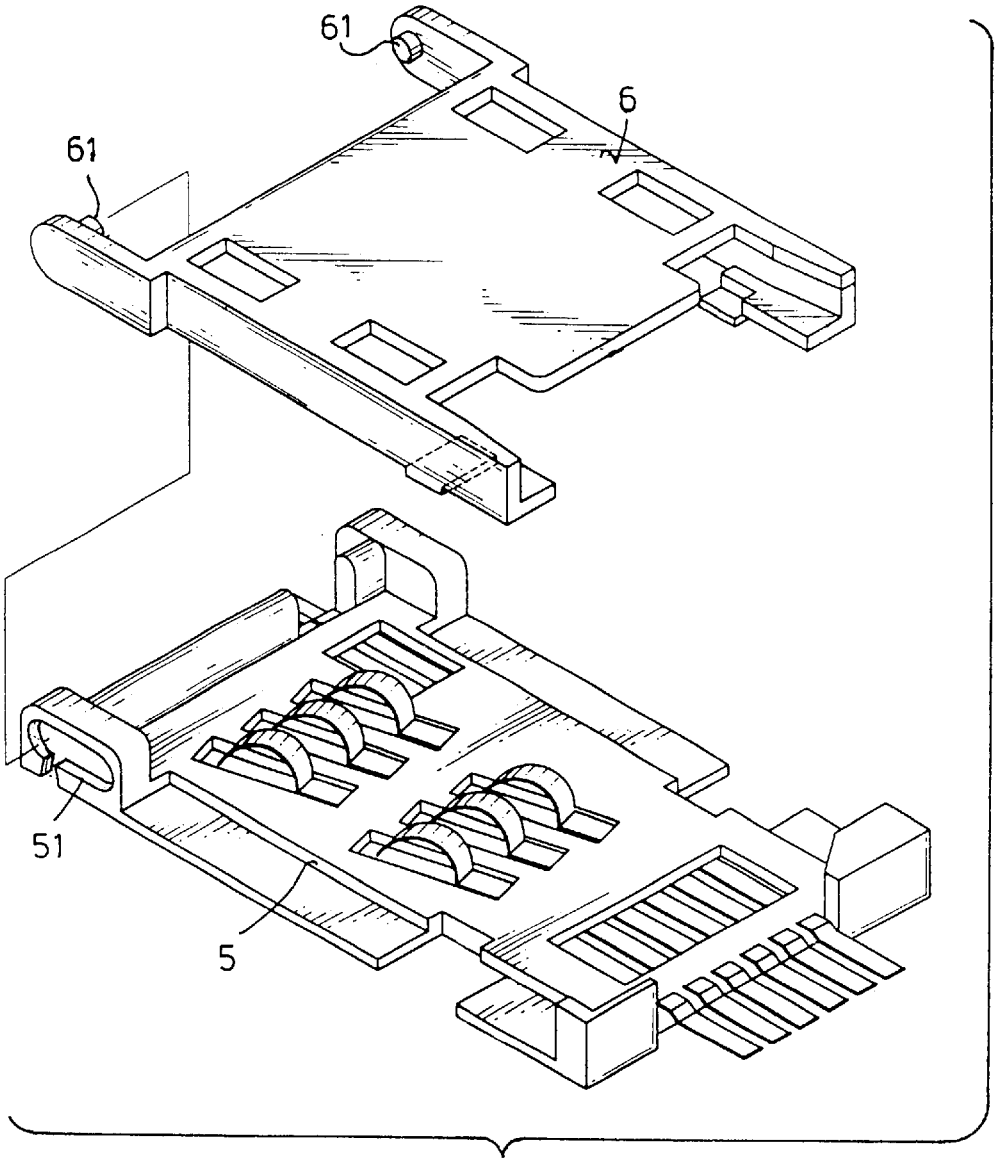
Fig. 1 PRIOR ART
FIG. 1 is a perspective exploded view of a conventional subscriber identification module card fixing seat.
Figure 2:
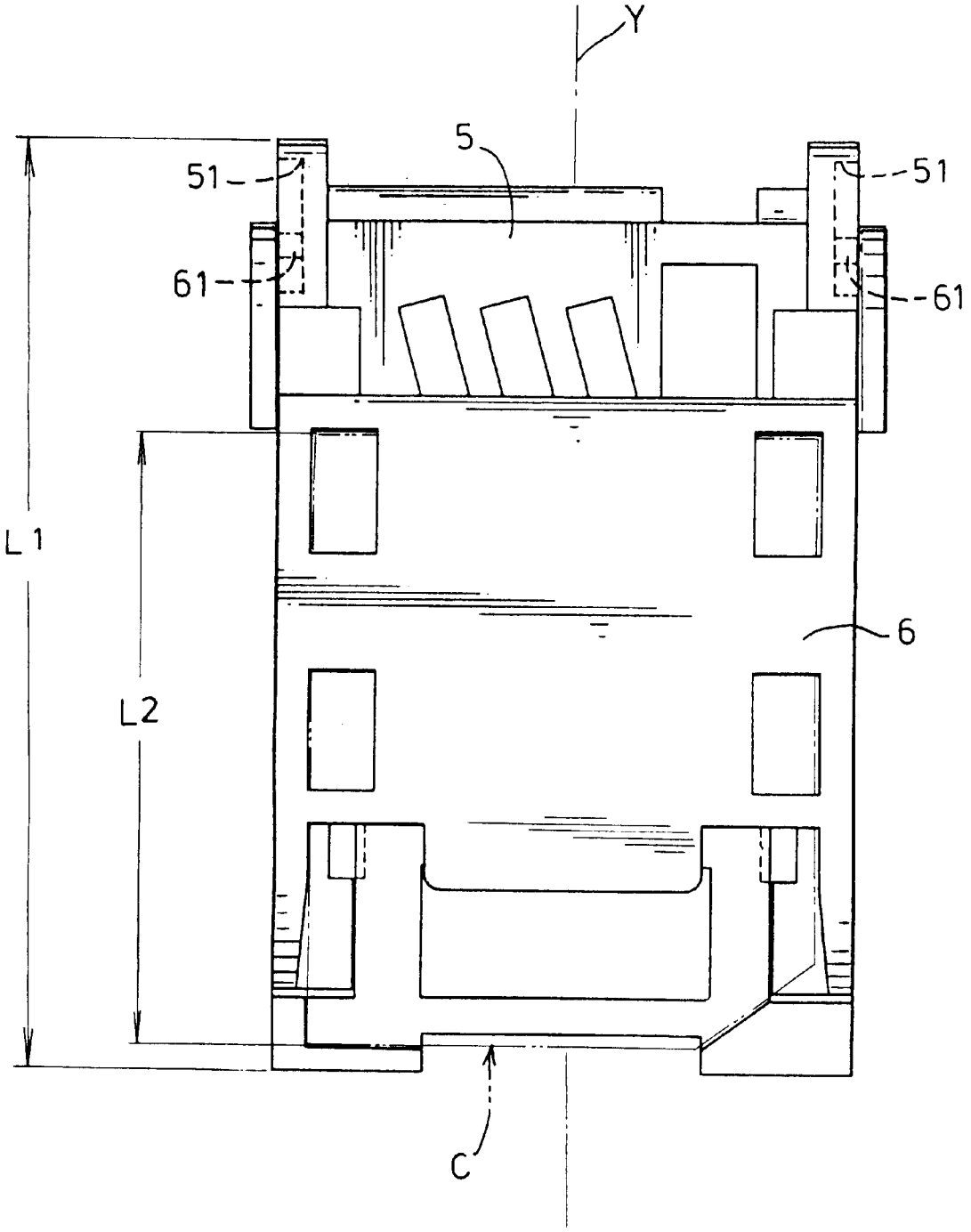
Fig. 2 PRIOR ART
FIG. 2 is a top view of the conventional subscriber identification module card fixing seat, showing that the upper cover of FIG. 1 is turned to cover the base seat.

Please refer to FIGS. 3 to 8. The fixing seat 100 of the present invention includes: a base seat 1, a top face of the base seat 1 being recessed to form a receiving cavity 10 in which a subscriber identification module (SIM) card 3 is snugly received and bridged, multiple connecting terminals 4 are arranged and inlaid in a bottom board body 11 of the receiving cavity 10 for electrically connecting with the SIM card 3, at least one shaft seat 12 being disposed on one side of the receiving cavity 10 of the base seat 1; and an upper cover 2 including a cover board 21. A first side of the cover board 21 is connected with a rotary shaft 22 which is slidably pivotally mounted in the shaft seat 12 of the base seat 1. At least one latch hook 23 downward projects from a second side of the cover board 21 for slidably hooking the base seat 1. The cover board 21 serves to firmly press the SIM card 3 against the base seat 1 so as to electrically connect the SIM card 3 with the connecting terminals 4. The shaft seat 12 of the base seat 1 for pivotally connecting with the upper cover 2 is disposed on a lateral side of the receiving cavity 10 so that the necessary length of the base seat 1 is greatly shortened to reduce the occupied room.

Figure 3:
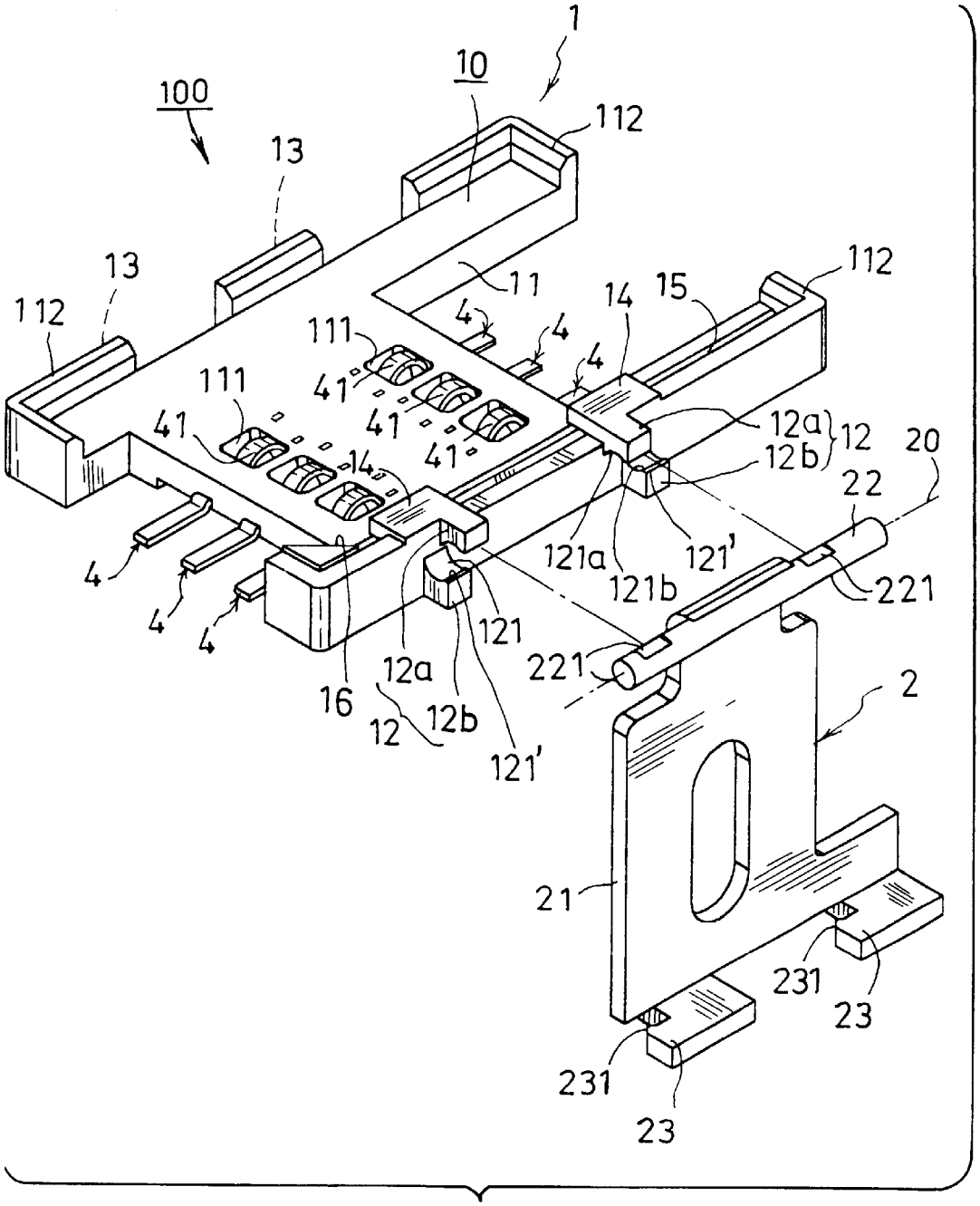
FIG. 3 is a perspective exploded view of the subscriber identification module card fixing seat of the present invention.
Figure 4:
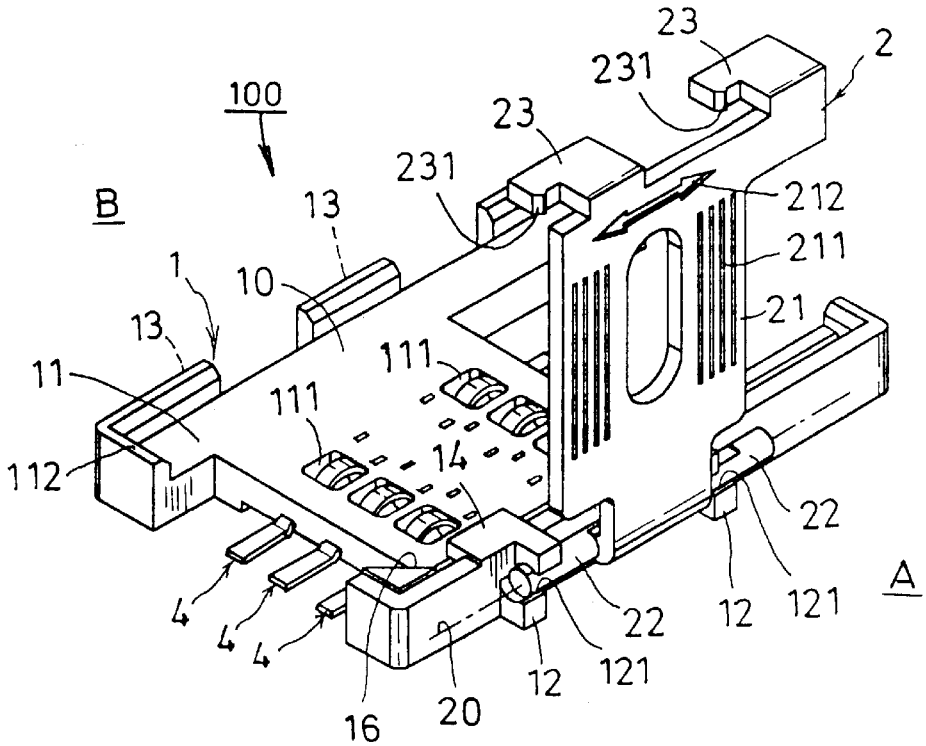
FIG. 4 is a right perspective assembled view of the subscriber identification module card fixing seat of the present invention.

Please refer to FIGS. 3 and 4. The base seat 1 of the present invention is made of insulating material by integral injection molding. The base seat 1 includes: a board body 11 formed with multiple terminal insertion perforations 111 arranged on the board body 11, a connecting terminal 4 being inlaid in each of the insertion perforations 111 with a contact end 41 of the connecting terminal 4 protruding beyond the board body 11, each edge of the board body 11 having at least one upward perpendicularly projecting wall 112, the projecting wall 112 and the board body 11 defining a receiving cavity 10 for snugly receiving therein a SIM card 3; at least one shaft seat 12 projecting from a first side A of the receiving cavity 10, the shaft seat 12 being formed with a shaft hole 121; and a hook dent 13 disposed on a second side B of the receiving cavity 10 opposite to the shaft seat. An opening of the hook dent 13 is formed with a projecting section 131 for hooking and latching the latch hook 23 of the upper cover 2. The bottom of the board body 11 is formed with multiple locating posts 17 which are correspondingly inserted onto a circuit board (not shown).

Figure 5:
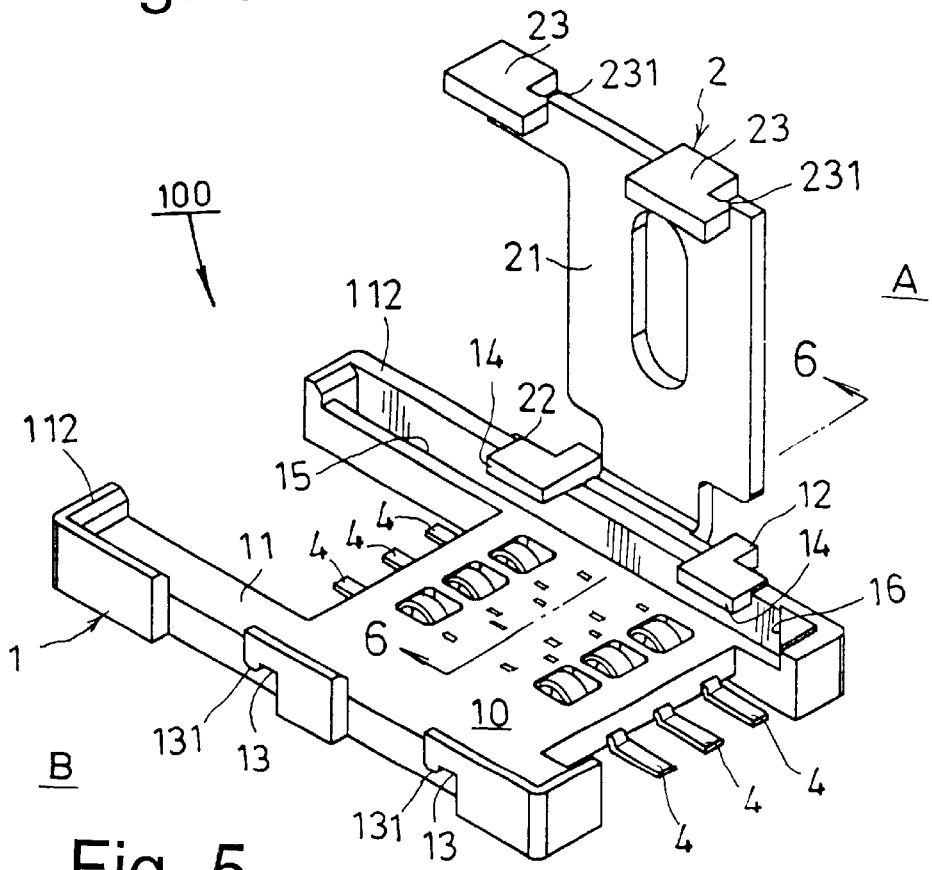
FIG. 5 is a left perspective assembled view of the subscriber identification module card fixing seat of the present invention.
Figure 6:
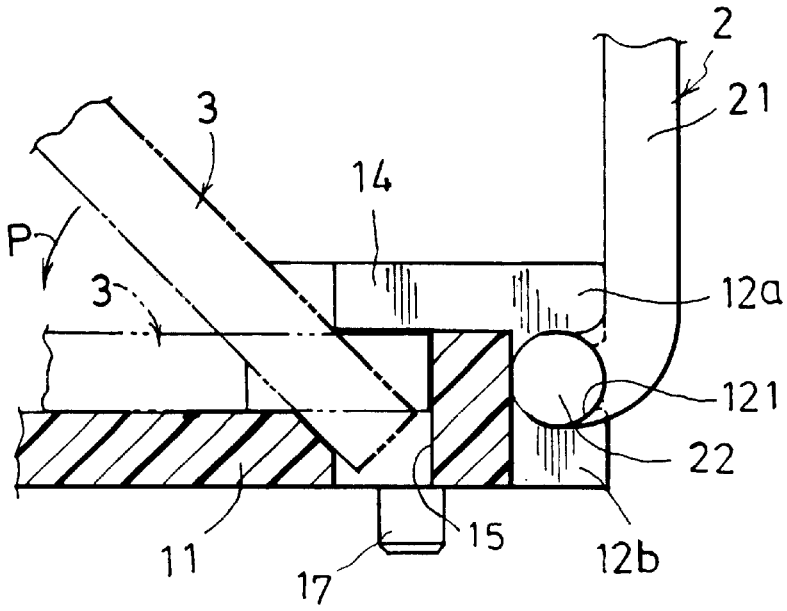
FIG. 6 is a sectional view taken along line 6—6 of FIG. 5.
Figure 7:
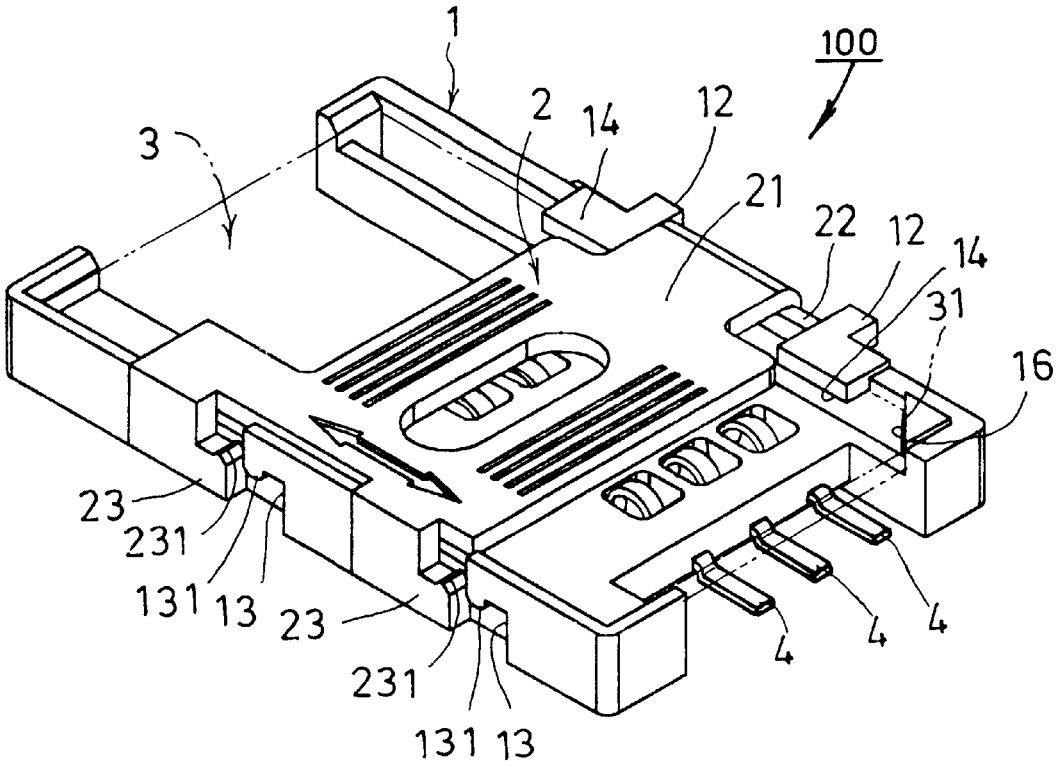
FIG. 7 is a perspective view showing that the upper cover of FIG. 5 is turned downward to cover the base seat.

The inner side of a projecting wall 112 of one side of the receiving cavity 10 has at least one radially extending stop board 14. The stop board 14 attaches to the upper edge of the SIM card 3 to stop the SIM card 3 from jumping and slipping upward. One side of the board body 11 is formed with a lengthwise elongated channel 15 under the stop board 14 as a projection thereof. As shown in FIGS. 5 and 6, when placing in the SIM card 3, a lateral edge of the SIM card 3 is first extended into the elongated channel 15 and then the other side of the SIM card 3 is pressed down so as to excessfully planely attach the SIM card 3 onto the board body 11.

Referring to FIGS. 3 and 4, the shaft seat 12 of the base seat 1 includes: an upper seat body 12*a* connected with upper edge of the base seat 1, a bottom end of the upper seat body 12*a* being upward recessed to form an upper half 121*a* of the shaft hole; and a lower seat body 12*b* connected with the lower side of the base seat 1. A top end of the lower seat body 12*b* is downward recessed to form a lower half 121*b* of the shaft hole. The lower half 121*b* and the upper half 121*a* of the shaft hole axially projectively together form a shaft hole 121. One side of the shaft hole 121 has an open section 121', whereby the rotary shaft 22 of the upper cover 2 can be laterally placed into the shaft hole 121.

One corner of the receiving cavity 10 is formed with a standard slope face 16 corresponding to a cut angle of one side of the SIM card 3, whereby a user can place in the SIM card 3 in a correct direction.

The upper cover 2 is made of insulating material by integral injection molding. The upper cover 2 includes: a cover board 21, a face of the cover board 21 being formed with multiple slipproof stripes 211 and an indicating mark 212 for indicating the sliding direction of the upper cover 21; at least one rotary shaft 22 connected with bottom end of a first side A of the cover board 21, the rotary shaft 22 being pivotally mounted in the shaft seat 12 of the base seat 1, permitting the upper cover 2 to axially slide in a direction along the axis 20 of the rotary shaft 22; and at least one latch hook 23 which is L-shaped and radially extends from a second side B of the cover board 21, a free end of the latch hook 23 having a projecting section 231 which can be correspondingly hooked and latched in the hook dent 13 of the base seat 1.

The rotary shaft 22 of the upper cover 2 is formed with multiple recessed sections 221 where the rotary shaft 22 has an outer diameter smaller than or equal to the width of the open section 121' of the shaft hole 121 of the shaft seat 12. Therefore, by a specific angle, the rotary shaft 22 can be correspondingly installed into the shaft hole 121 of the shaft seat 12. As shown in FIG. 3, the upper cover 2 is placed into the shaft seat 12 by 270 degrees. When the bottom of the base seat 1 is planely fixedly attached to an article, the upper cover 2 will be obstructed by the article from turning back to the position of 270 degrees. Therefore, the upper cover 2 can be firmly pivotally mounted in the shaft seat 12 without departing therefrom.

Figure 8:
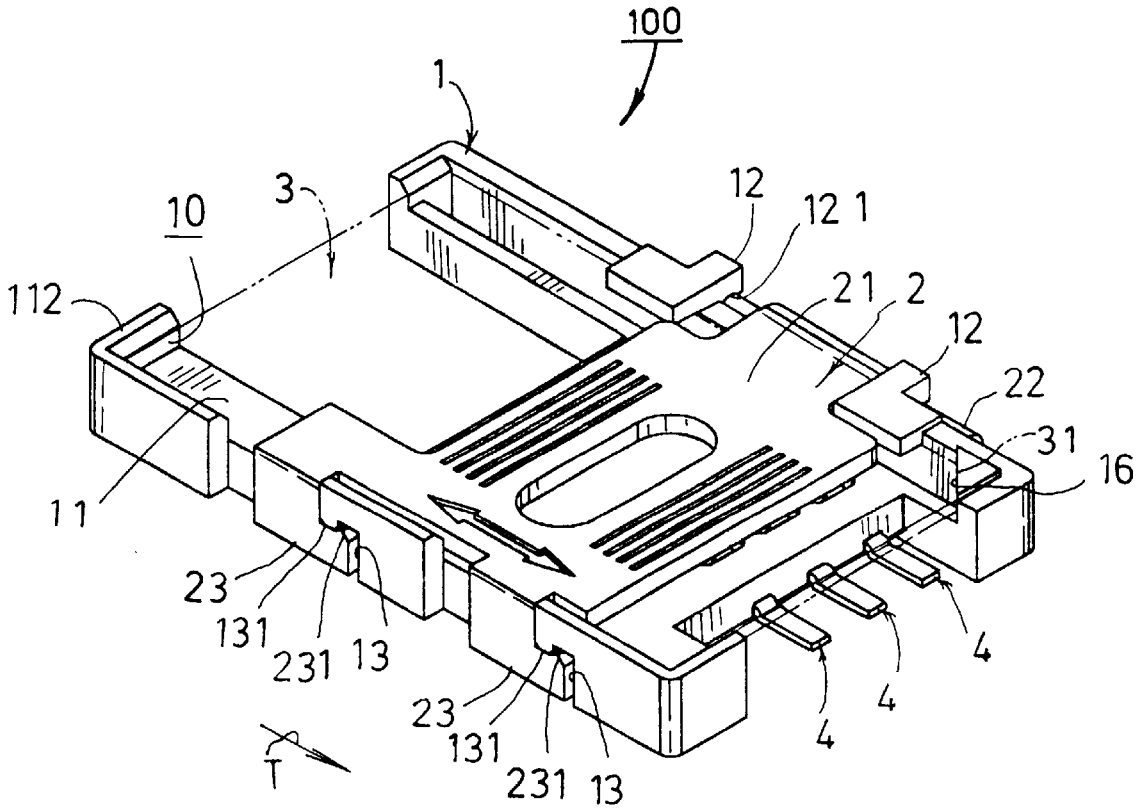
FIG. 8 is a view according to FIG. 7, showing that the upper cover is slided and firmly latched with the base seat.

The SIM card fixing seat with slidable and laterally latching cover of the present invention is applicable to a general mobile phone for fixing the identification SIM card thereof. As shown in FIGS. 5 and 6, when installing the SIM card 3 into the fixing seat, a user first aims the cut angle 31 of the SIM card 3 at the standard slope face 16 of the receiving cavity and then obliquely extends the front edge of the SIM card 3 into the elongated channel 15 of the base seat 1. Then the other side of the SIM card 3 is pressed down in direction P so as to successfully place the SIM card 3 into the receiving cavity 10 and bridge the SIM card 3 over the connecting terminals 4 of the board body 11 of the base seat 1. Accordingly, as shown in FIG. 5, the user turns over the upper cover 2, making the cover board 21 thereof bridge over the SIM card 3. Then, as shown in FIG. 8, the upper cover 2 is slided in direction T to make the projecting sections 231 of the free ends of the latch hooks 23 of the upper cover 2 correspondingly hooked and latched in the hook dents 13 of the base seat 1. Under such circumstance, the upper cover 2 is latched and cannot be turned up. Therefore, the cover board 21 of the upper cover firmly tightly presses the SIM card 3 against the connecting terminals 4 of the base seat 1 to electrically connect therewith.

The rotary shaft 22 of the upper cover 2 is slidably pivotally mounted in the shaft seat 12 of the lateral side of the base seat 1, permitting the upper cover 2 to axially slide in a direction along the axis 20 of the rotary shaft 22. Accordingly, the present invention has the following advantages:

1. The shaft seat 12 of the base seat 1 is disposed on a lateral side of the receiving cavity 10 so that the length of the base seat 1 is only about 27 mm, shorter than that of the conventional device. (In order to provide sufficient length for the pivot bosses of the cover body to slide along the end of the base seat, the conventional base seat is longer, about 30 mm. Therefore, the room necessary for installation is reduced so that the present invention is applicable to a more mini-type mobile phone.

2. When installing the SIM card, the SIM card is directly placed into the receiving cavity of the base seat. After the SIM card is well placed, the upper cover is then turned downward and slided to be latched. Therefore, the SIM card is protected from being damaged due to misinstallation.

The above embodiment is only used to illustrate the present invention, not intended to limit the scope thereof.

Many modifications of the above embodiment can be made without departing from the spirit of the present invention.

What is claimed is:

1. A subscriber identification module card fixing seat with slidable cover, comprising:

a base seat having a board body with a plurality of terminal insertion perforations formed therein, the board body having a recessed top face to form a receiving cavity into which a subscriber identification module card is snugly received, the terminal insertion perforations being respectively inlaid with a plurality of connecting terminals, each of the connecting terminals having a contact end protruding into the receiving cavity for electrically connecting with the subscriber identification module card, the base seat having at least one shaft seat disposed on one side of the receiving cavity of the base seat and a hook dent disposed on an opposing side of the receiving cavity, the shaft seat having a shaft hole formed therein, the hook dent having an opening and a projecting section extending into the opening, the receiving cavity having a longitudinally extended projecting wall on at least one side thereof with a transversely directed stop board for limiting upward movement of the subscriber identification module card in the receiving cavity, the board body having a longitudinally extended channel formed therein and disposed under the stop board for initially receiving an edge portion of the subscriber identification module card during installation thereof; and an upper cover including a cover board, a first side of the cover board being connected with a longitudinally extended rotary shaft which is pivotally mounted in the shaft seat of the base seat, permitting the upper cover to slide in a direction along a longitudinal axis of the rotary shaft, at least one latch hook downward projecting from a second side of the cover board for slidably hooking the hook dent and latching the projecting section responsive to sliding displacement of the upper cover, whereby the cover board firmly presses the subscriber identification module card against the base seat so as to make the subscriber identification module card electrically connect with the connecting terminals.

2. Subscriber identification module card fixing seat with slidable and laterally latching cover as claimed in claim 1, wherein the upper cover is made of insulating material by integral injection molding, including: a cover board, a face of the cover board being formed with multiple slipproof stripes and an indicating mark for indicating the sliding direction of the upper cover; at least one rotary shaft connected with bottom end of a first side of the cover board, the rotary shaft being slidably pivotally mounted in the shaft seat of the base seat; and at least one latch hook which is L-shaped and radially extends from a second side of the cover board, a free end of the latch hook having a projecting section which can be correspondingly hooked and latched in the hook dent of the base seat.

* * * * *